US010011417B2

(12) United States Patent
Degeorge

(10) Patent No.: US 10,011,417 B2
(45) Date of Patent: Jul. 3, 2018

(54) PAPERBOARD PACKAGING CONTAINERS AND RELATED METHODS OF USE

(71) Applicant: L'OREAL, Paris (FR)

(72) Inventor: Michael Degeorge, Old Bridge, NJ (US)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/707,676

(22) Filed: May 8, 2015

(65) Prior Publication Data

US 2015/0237989 A1 Aug. 27, 2015

Related U.S. Application Data

(63) Continuation of application No. 13/341,685, filed on Dec. 30, 2011, now Pat. No. 9,439,490.

(51) Int. Cl.
*B65D 81/32* (2006.01)
*B65D 17/28* (2006.01)
(Continued)

(52) U.S. Cl.
CPC ..... *B65D 81/32* (2013.01); *A45D 7/04* (2013.01); *A45D 19/00* (2013.01); *B65D 5/542* (2013.01);
(Continued)

(58) Field of Classification Search
CPC ..... A45D 40/24; A45D 34/04; A45D 7/04; A45D 7/06; A45D 7/00; A45D 2200/058;
(Continued)

(56) References Cited

U.S. PATENT DOCUMENTS 2,789,689 A * 4/1957 Lewis ..... B65D 5/4204 206/459.5
3,933,297 A 1/1976 Carlsson et al.
(Continued)

FOREIGN PATENT DOCUMENTS

FR 2706159 A1 12/1994
FR 2967143 A1 5/2012
(Continued)

OTHER PUBLICATIONS

International Search Report for corresponding International Application No. PCT/US2012/067206.
(Continued)

*Primary Examiner* — Tatiana Nobrega
(74) *Attorney, Agent, or Firm* — The Marbury Law Group, LLC

(57) ABSTRACT

A method for mixing substances for the treatment of keratinous substrates may comprise separating a paperboard packaging container into at least two portions. The method may also comprise removing at least two containers containing differing substances from the paperboard packaging container and mixing the at least two substances together in one of the at least two separated portions of the paperboard packaging container so as to form a mixture of the at least two substances for the treatment of keratinous substrates. The method may further comprise applying the mixture to a keratinous substrate.

2 Claims, 7 Drawing Sheets

(51) Int. Cl.

| | |
|---|---|
| ***A45D 7/04*** | (2006.01) |
| ***B65D 77/04*** | (2006.01) |
| ***B65D 81/36*** | (2006.01) |
| ***B65D 5/54*** | (2006.01) |
| ***B65D 5/66*** | (2006.01) |
| *A45D 19/00* | (2006.01) |
| *A45D 7/00* | (2006.01) |
| *B65D 5/56* | (2006.01) |

(52) U.S. Cl.
CPC ..... *B65D 5/5425* (2013.01); *B65D 5/5445* (2013.01); *B65D 5/6602* (2013.01); *B65D 17/28* (2018.01); *B65D 77/042* (2013.01); *B65D 77/0413* (2013.01); *B65D 81/36* (2013.01); *A45D 2007/001* (2013.01); *A45D 2019/0041* (2013.01); *A45D 2019/0066* (2013.01); *A45D 2200/058* (2013.01); *A45D 2200/25* (2013.01); *B65D 5/563* (2013.01)

(58) Field of Classification Search
CPC ..... A45D 2019/0041; A45D 2019/005; A45D 2019/0066; A45D 2007/001; B65D 81/32; B65D 51/222; B65D 51/223; B65D 51/228; B65D 17/28
USPC ..... 132/208, 202, 204, 286, 317, 200; 206/223, 568, 581, 38, 575
See application file for complete search history.

(56) References Cited

U.S. PATENT DOCUMENTS

| | | | | |
|---|---|---|---|---|
| 4,006,820 | A | 2/1977 | Smith | |
| 4,506,783 | A * | 3/1985 | Morganroth | A45D 19/0008 206/221 |
| 4,836,378 | A * | 6/1989 | Lephardt | B65D 75/66 206/264 |
| 4,950,485 | A * | 8/1990 | Akhtar | A61K 8/19 132/202 |
| 5,172,652 | A | 12/1992 | Dobrin et al. | |
| 5,209,565 | A | 5/1993 | Goncalves | |
| 5,223,245 | A | 6/1993 | Ibrahim et al. | |
| 5,275,332 | A | 1/1994 | Heuberger et al. | |
| 5,551,454 | A | 9/1996 | Goncalves | |
| 6,106,917 | A | 8/2000 | Pereira et al. | |
| 6,935,557 | B2 * | 8/2005 | Aubry | B65D 5/5445 229/101 |
| 7,232,466 | B2 * | 6/2007 | Narasimhan | A61K 8/22 132/202 |
| 7,407,055 | B2 | 8/2008 | Rodriguez | |
| 7,721,940 | B2 | 5/2010 | Moenne-Loccoz et al. | |
| 2002/0185390 | A1 | 12/2002 | Ciguere | |
| 2003/0116614 | A1 | 6/2003 | Block et al. | |
| 2003/0228336 | A1 * | 12/2003 | Gervasio | A45D 34/00 424/401 |
| 2004/0089316 | A1 * | 5/2004 | Hamilton | A45D 19/00 132/208 |
| 2005/0211599 | A1 * | 9/2005 | De La Mettrie | A45D 44/005 206/581 |
| 2006/0193952 | A1 * | 8/2006 | Penttinen | B32B 27/10 426/106 |
| 2007/0000070 | A1 * | 1/2007 | Vena | A61K 8/19 8/405 |
| 2007/0062956 | A1 * | 3/2007 | Roher | A45D 44/005 220/520 |
| 2007/0144550 | A1 * | 6/2007 | Roher | A45D 19/0008 132/208 |
| 2007/0169285 | A1 * | 7/2007 | Narasimhan | A61K 8/31 8/405 |
| 2008/0178399 | A1 * | 7/2008 | Vena | A61K 8/463 8/407 |
| 2008/0277462 | A1 * | 11/2008 | Smorch | B65D 5/5435 229/229 |
| 2010/0037403 | A1 * | 2/2010 | Houtan | A45D 19/00 8/406 |
| 2010/0084460 | A1 | 4/2010 | Lo Duca | |
| 2010/0154816 | A1 * | 6/2010 | Goddard-Clark | A61K 8/19 132/208 |
| 2010/0200012 | A1 | 8/2010 | Sloan | |
| 2011/0098167 | A1 | 4/2011 | Mathieu et al. | |

FOREIGN PATENT DOCUMENTS

| | | |
|---|---|---|
| GB | 1053868 A | 1/1967 |
| WO | 01/26996 A1 | 4/2001 |

OTHER PUBLICATIONS

Written Opinion for corresponding International Application No. PCT/US2012/067206.

Fontaine, M., Unpublished French Patent Application No. 1059314 entitled: Assembly for Packaging Products to be Mixed Extemporaneously and Method for Producing Such an Assembly; Filed Nov. 10, 2010; pp. 1-18. (An English language abstract was provided).

English language abstract of FR 2967143. (Dec. 16, 1994).

International Preliminary Report on Patentability and Written Opinion for PCT/US2012/067206, dated Jul. 10, 2014.

* cited by examiner

PAPERBOARD PACKAGING CONTAINERS AND RELATED METHODS OF USE

This is a continuation of application Ser. No. 13/341,685, filed Dec. 30, 2011, which is incorporated herein by reference.

TECHNICAL FIELD

The present disclosure relates to packaging, and related kits and methods, for substances to be mixed for the treatment of keratinous substrates, such as for example, hair and skin.

INTRODUCTION

The section headings used herein are for organizational purposes only and are not to be construed as limiting the subject matter described in any way.

Various keratinous substrate treatment products, including for example for the skin and/or hair, utilize multiple (e.g., two or more) substances that are initially in separate containers and then mixed together before use. By way of example, hair treatment products, such as, for example, hair-coloring (e.g., permanent, demi-permanent, or semi-permanent hair dyeing and highlighting) and hair relaxer products generally utilize at least two substances that are initially provided in separate containers and mixed together before, generally approximately immediately before, use for application to the hair. Such products are therefore generally packaged as a kit (e.g., a keratinous substrate coloring or treatment kit) that includes an empty mixing tray into which the separate substances can be introduced and mixed together when ready for use. Although convenient for consumers, such disposable mixing trays account for a large portion of the kit's packaging waste. Moreover, many such mixing trays are made of a plastic material that can take years to degrade and can be expensive to recycle.

With growing concerns for the environment, including global warming concerns for example, it is desirable to address the drawbacks of the amount of waste derived from current packaging for various consumer products, including hair and other keratinous substrate treatment products. For example, it may be desirable to provide "green," or environmentally friendly packaging alternatives that can reduce waste and/or are made substantially of renewable resources. It also may be desirable to be able to reduce the overall size of the packaging as a way to reduce waste. Further, it may be desirable to reduce the size and number of parts of packaging for keratinous substrate treatment kits that can reduce costs associated with manufacturing and/or shipping and handling. Such cost reductions in turn can have a beneficial impact on the environment through, for example, reducing oil and other energy consumption associated with manufacturing and/or shipping and handling.

SUMMARY

Various exemplary embodiments of the present disclosure may solve one or more of the above-mentioned problems and/or may demonstrate one or more of the above-mentioned desirable features. Other features and/or advantages may become apparent from the description that follows.

In accordance with various exemplary embodiments, a method for mixing substances for the treatment of keratinous substrates may comprise separating a paperboard packaging container into at least two portions. The method may also comprise removing at least two containers containing differing substances from the paperboard packaging container and mixing the at least two substances together in one of the at least two separated portions of the paperboard packaging container so as to form a mixture of the at least two substances for the treatment of keratinous substrates. The method may further comprise applying the mixture to a keratinous substrate.

In accordance with various additional exemplary embodiments, a keratinous substrate treatment kit may comprise a paperboard packaging container and at least two containers disposed within the paperboard packaging container. The at least two containers may contain differing substances configured to be mixed together to form a mixture for treating keratinous substrates. The paperboard packaging container can be configurable from a first configuration containing the at least two containers to a second configuration providing a volume sufficient to receive the substances from the at least two containers for mixing the substances together.

In accordance with various further exemplary embodiments, a paperboard packaging container for packaging components used to treat keratinous substrates may comprise a foldable box defining an inner space and comprising a body having lateral side faces and two end faces. The box is formed from a planar blank, and the body faces each have two opposite ends, a first end comprising flaps that cooperate to form a bottom end face of the foldable box and a second end comprising flaps that cooperate to form a top end face of the foldable box. The foldable box further comprises at least one perforated tear line at least partially around a periphery of the foldable box so as to divide the foldable box into at least two portions. At least one portion of the foldable box is configured for receiving a mixture of at least two substances for treating a keratinous substrate.

Additional objects and advantages will be set forth in part in the description which follows, and in part will be obvious from the description, or may be learned by practice of the present disclosure. At least some of those objects and advantages may be realized and attained by means of the elements and combinations particularly pointed out in the appended claims and their equivalents.

It is to be understood that both the foregoing general description and the following detailed description are exemplary and explanatory only and are not restrictive of the present disclosure or claims.

BRIEF DESCRIPTION OF THE DRAWINGS

The present disclosure and claims can be better understood from the following detailed description either alone or together with the accompanying drawings. The drawings are included to provide a further understanding, and are incorporated in and constitute a part of this specification. The drawings illustrate one or more exemplary embodiments of the present disclosure and together with the description serve to explain various principles and operation.

DETAILED DESCRIPTION OF VARIOUS EXEMPLARY EMBODIMENTS

Figure 1A:
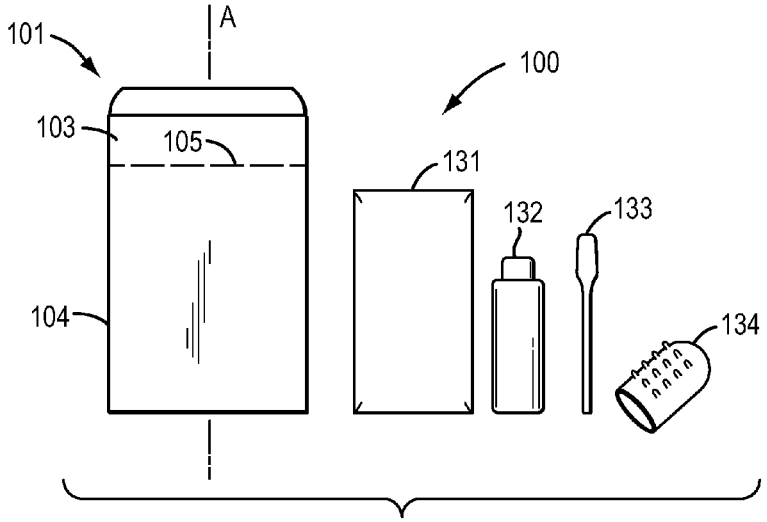
FIG. 1A is a front perspective view of an exemplary embodiment of a hair treatment kit with a packaging container in a closed configuration and with its contents removed in accordance with the present disclosure.

Reference will now be made in detail to various exemplary embodiments of the present disclosure, examples of which are illustrated in the accompanying drawings.

A variety of conventional kits for treating keratinous substrates include several substances that need to be mixed together before use, for example approximately immediately before use. For example, kits for treating hair may contain substances that are mixed together to form, for example, a permanent, demi-permanent, or semi-permanent dye, a highlighter, a relaxer, or a straightener. In various additional embodiments, kits for treating skin may contain substances that are mixed together to form facial products, such as, for example, vitamin C serums. Conventionally, such kits also include a mixing tray, e.g., a plastic mixing tray, that is packaged as a component of the kit and used for mixing the treatment substances together prior to use. Although convenient for consumers, such mixing trays generate a significant amount of packaging waste. To provide more sustainable packaging and decrease the amount of packaging waste from such kits, various exemplary embodiments of the present disclosure provide kits and methods for hair treatment that utilize a packaging container, a portion of which can be used to mix the substances together to obtain the hair treatment product, thereby eliminating the need for a separate mixing tray. In various exemplary embodiments, hair treatment kits and methods may utilize a foldable box as the packaging container. In various exemplary embodiments, the foldable box has at least one perforated tear line at least partially around the periphery of the box, which can provide a mechanism to open the box and divide it into at least two portions, at least one of which can be configured for receiving and mixing the substances for treating the hair.

In various exemplary embodiments, the packaging container may be made of a paperboard material. Further, in various exemplary embodiments, portions of the packaging container, for example, at least inner surface portions intended to receive the substances for mixing, can be sufficiently hydrophobic so as to provide a barrier to the liquid parts of the substances to be mixed, and in some cases can act as a vapor barrier. By way of example, hydrophobic coatings or linings may be provided on all portions of a paperboard material from which the packaging container is made.

As used herein, the term "keratinous substrate treatment" and variations thereof refers to the treatment and/or maintenance of keratinous substrates, such as, for example, hair, skin, and/or nails on the human head and/or body. Keratinous substrate treatment may differ according to one's hair, skin, and/or nail type and according to various processes that can be applied to hair, skin and/or nails. In various exemplary embodiments, for example, hair treatment may include the processes of dyeing, highlighting, conditioning, straightening and/or relaxing hair. As used herein, the term "keratinous substrate treatment kit" and variations thereof generally refers to a set of substances and/or implements used for hair, skin, and/or nail treatment that are packaged together. Accordingly, as used herein, the term keratinous substrate treatment kit encompasses the packaging container containing the keratinous substrate treatment substances. Any of such kits may be kits that are commercially available for in-home or professional use. By way of example only, hair treatment kits in accordance with the present disclosure may include, for example, hair color (including permanent, demi-permanent, or semi-permanent dyes and highlighting substances), relaxer, and/or straightening kits that are commercially available for in-home or professional use.

Those of ordinary skill in the art would understand that keratinous substrate treatment kits in accordance with the present disclosure may also include various types of substances, including, but not limited to, various powder, gel, cream and/or liquid substances, and any combinations thereof, that form, for example, various liquid or semi-liquid pastes when mixed.

Figure 1B:
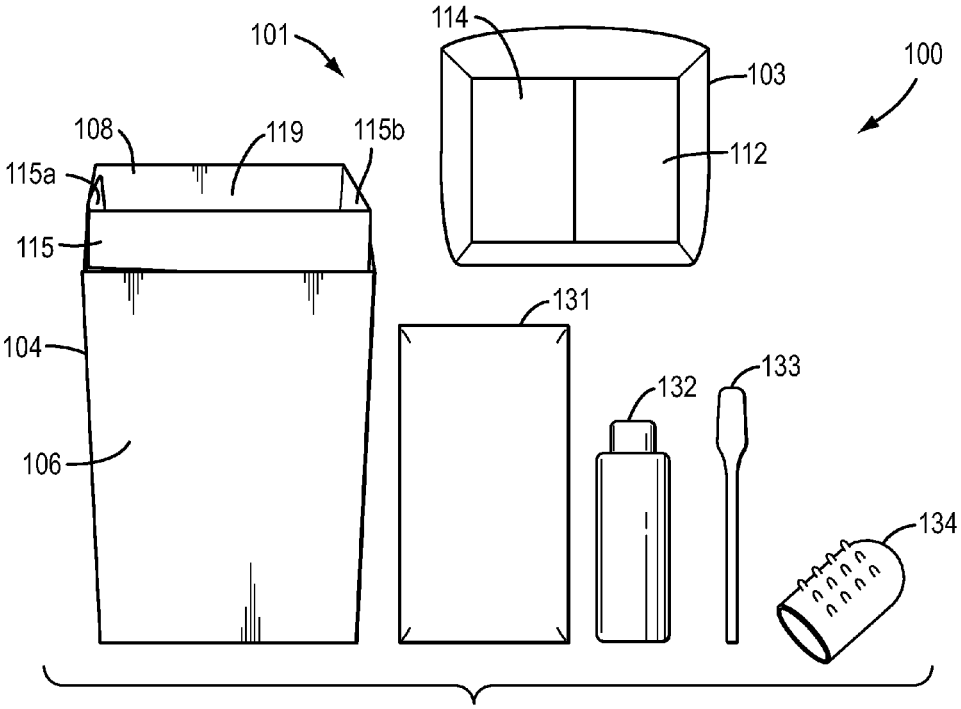
FIG. 1B is a front perspective view of the hair treatment kit of FIG. 1A with the packaging container in an open configuration.

FIGS. 1A and 1B illustrate an exemplary hair treatment kit in accordance with various exemplary embodiments of the present disclosure. A hair treatment kit 100 may include, for example, a packaging container 101 configured to house at least two containers 131 and 132 respectively holding substances configured to be mixed together before use (e.g., substantially immediately before use) to obtain a hair treatment product. FIG. 1A depicts the packaging container 101 in a closed position and FIG. 1B depicts the packaging container 101 in an open position. Those having ordinary skill in the art will appreciate that prior to use, the packaging container 101 can contain the various other components shown and described therein, but for ease of illustration and discussion those components are shown outside of the packaging container 101 in FIGS. 1A and 1B.

In various embodiments of the present disclosure, for example, the substances contained in the containers 131 and 132 may respectively comprise a dye and a developer configured to be mixed together before use to obtain a hair coloring product. In various additional embodiments, the substances in the containers 131 and 132 may comprise a relaxer or straightener comprising a least two parts, which are configured to be mixed together immediately before use to obtain a hair relaxing product. As those ordinarily skilled in the art would understand, for example, in various embodiments, a relaxer may comprise an alkaline component and an activator, which are configured to be mixed together immediately before use to obtain a no-lye hair relaxer.

Those ordinarily skilled in the art would understand, however, that the kit 100 may comprise any number and/or type of substances that are configured to mixed together to obtain a hair treatment product, including, for example, various powders, gels, creams and/or liquid products, without departing from the scope of the present disclosure. Those of ordinary skill in the art would further understand that the containers 131 and 132 shown in the embodiment of FIGS. 1A and 1B are exemplary only and that any number and/or type of containers may used depending on the type of substances being provided therein. Further, those having ordinary skill in the art would appreciate that more than two containers may be packaged in the packaging container 101 depending, for example, on the number of substances that are desired to be held separately prior to mixing for use.

As shown in FIGS. 1A and 1B, in various exemplary embodiments of the present disclosure, the hair treatment kit 100 may further include a mixing tool 133 to mix the substances together, and an applicator 134 to apply the mixture of substances, for example, to hair. Although not depicted, those ordinarily skilled in the art would further understand that the hair treatment kit 100 may include any number and/or type of additional components, including, for example, instructions, gloves, caps, additional containers containing substances not intended for mixing, such as, for example, rinsing, conditioning, and/or neutralizing products, and other items found in hair treatment kits as would be known to those having ordinary skill in the art. Those ordinarily skilled in the art would also understand that the mixing tool 133 and the applicator 134 depicted in FIGS. 1A and 1B are exemplary only and that the kit 100 may include various implements and/or tools for use in conjunction with hair treatment products, including, but not limited to, various spoons, stirrers, finger tools, combs and/or brushes. In accordance with the present disclosure, however, it is contemplated that exemplary embodiments of hair treatment kits will not include a separate mixing tray held within the packaging container 101.

Figure 4:
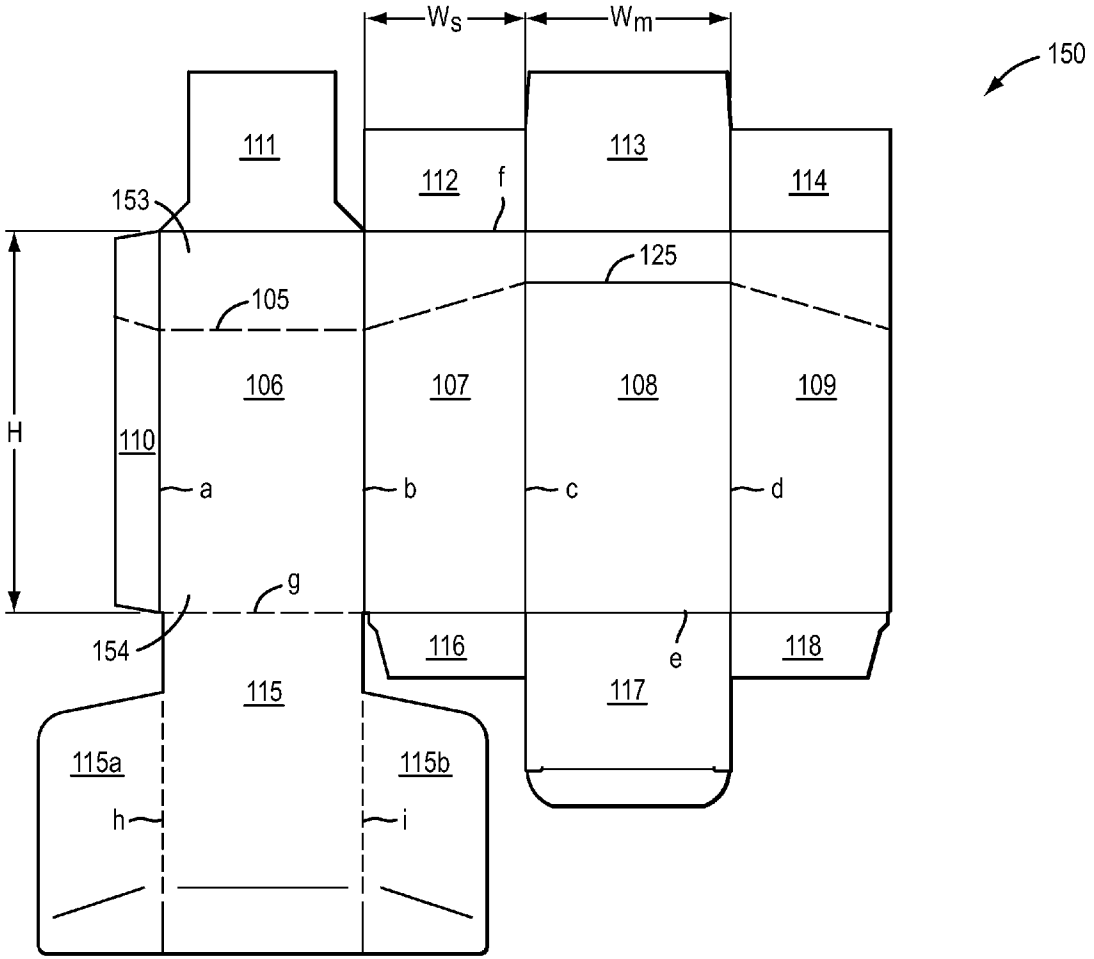
FIG. 4 is a plan view of an exemplary embodiment of a blank used to form the packaging container of the kit of FIG. 1A.

In various exemplary embodiments, the packaging container 101 may comprise a foldable box. As shown in FIG. 4, for example, in various embodiments, the packaging container 101 is formed from a planar blank, which may be folded to form a structure suitable for containing the contents of the kit 100 (e.g., the containers 131 and 132, and optionally other components such as the mixing tool 133 and applicator 134). The foldable box, may therefore be broken down to reduce its overall size (e.g., unfolded to a flat form) for disposal and/or recycling.

In various additional exemplary embodiments, the packaging container 101 may comprise any paperboard carton, box and/or other structure suitable for containing the contents of the kit 100. For environmental purposes (e.g., including ease of recycling), for example, in various exemplary embodiments, the container 101 may be made, for example, from recycled and/or biodegradable materials, such as paperboard for example. Those ordinarily skilled in the art would understand, however, that the packaging container 101 may be formed from various paper pulp based materials.

In various exemplary embodiments of the present disclosure, one or more portions of the container 101 can provide a liquid and/or vapor barrier, such that when liquid substances are mixed within the container 101 they do not bleed through and/or leak from the container 101. Those ordinarily skilled in the art would understand that various methods and/or techniques may be used to provide such a barrier.

In various exemplary embodiments, for example, the container 101 may be formed from a paperboard material with a hydrophobic coating, such as, for example, a low-density polyethylene (LDPE) coating. For example, at least interior surface portions of the container 101 are provided with a hydrophobic material coating or other layers deposited thereon. In various exemplary embodiments, both exterior and interior surface portions may be provided with the hydrophobic material. Further, in various exemplary embodiments, portions of the container 101 may be provided with the hydrophobic material coating or layer and other portions may be free of the same. For example, in at least one exemplary embodiment, the hydrophobic material is provided on the interior and/or exterior surface portions of a part of the container intended to be used for receiving and mixing the substances, for example, a bottom portion of the container in various exemplary embodiments. Those ordinarily skilled in the art would further understand that the type and/or thickness of paperboard material used for the container 101, and the type and/or thickness of the coating applied (if any), may be chosen based on the components being packaged, the substances being mixed, the water vapor transmission rate of the coating, cost, and other design factors. In various embodiments, for example, instead of coating portions of the container 101, one of the substances may be packaged, for example, in a film pouch or bag that may be used to line the interior surface portions of the portion of the container intended to be used for receiving and mixing the substances.

Figure 2:
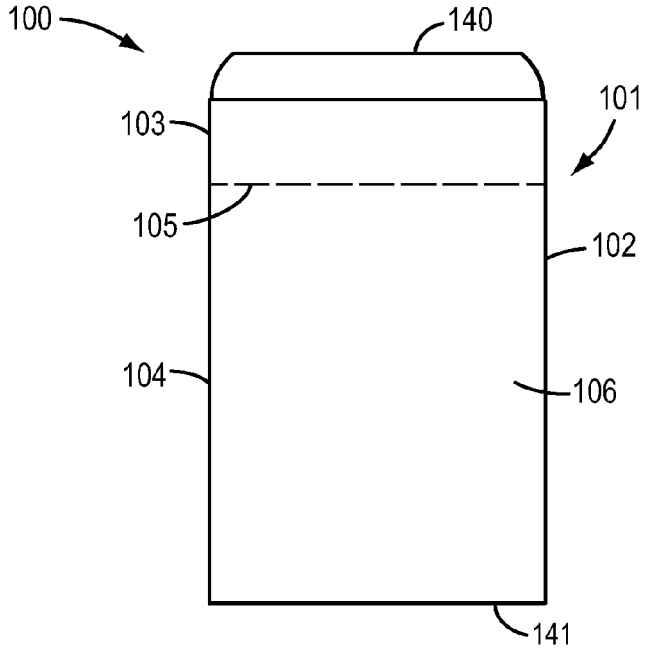
FIG. 2 is a front view of an exemplary embodiment of the packaging container of the kit of FIG. 1A.
Figure 3:
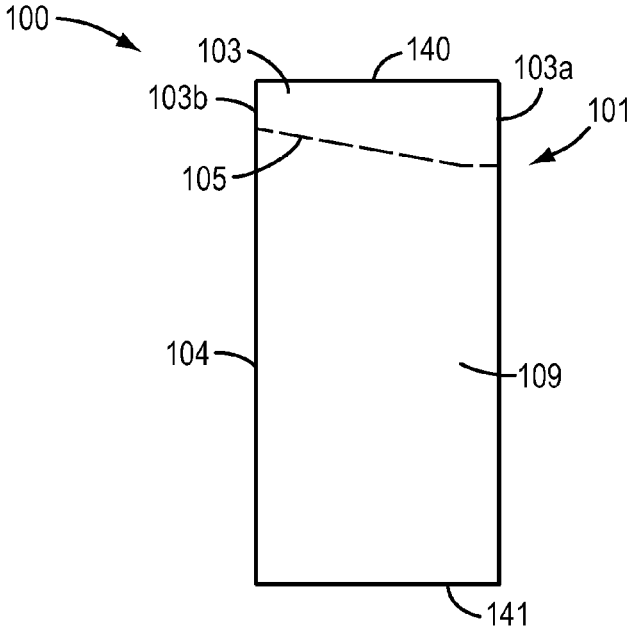
FIG. 3 is a side view of the packaging container of the kit of FIG. 1A.

In accordance with various exemplary embodiments of the present disclosure, as shown in FIGS. 2 and 3, the packaging container 101 may comprise at least one perforated tear line 105, which wraps at least partially around the periphery of the container 101 so as to divide the container 101 into two portions 103 and 104. As shown in FIG. 1A, in an exemplary embodiment, the tear line 105 can wrap around the entire periphery of the container 101, extending in a direction that is substantially transverse to a longitudinal axis A of the container 101. In such a configuration, the container 101 may be opened by tearing the container 101 along the perforated tear line 105 and a first portion 103 of the container 101 can be separated and removed from a second portion 104, as illustrated in FIG. 1B. In various exemplary embodiments, at least one of the portions 103 and 104 can provide a structure and volume sufficient for receipt and mixing of substances in containers 131 and 132. Thus, in accordance with various exemplary embodiments of the present disclosure, the kit 100 does not include a separate mixing tray for mixing the substances of containers 131 and 132 together, but utilizes a portion of the packaging container 101 (i.e., portion 103 and/or portion 104) to mix the substances, as described below with reference to FIGS. 5A-5D for example.

Although the exemplary embodiments of FIGS. 1A and 1B illustrate a packaging container 101 having a tear line 105 that extends around the entire periphery of the container 101, in alternative exemplary embodiments, the tear line 105 can extend only partially around the periphery. In this way, the container can be opened with the two portions separated from each other into differing volumes but still connected (see, e.g., FIG. 5A). For example, the tear line could extend around three faces of the container 101 and not around a fourth face in a configuration wherein the container 101 is in the shape of a box.

For a better understanding of an exemplary construction of a packaging container, such as, e.g., packaging container 101, that has a foldable box configuration, reference is now made to FIG. 4, the parts of which are indicated, wherever possible, using the same reference numerals, with subscripts, as for the corresponding parts of the assembled packaging container 101 shown in FIGS. 1-3. As shown in FIG. 4, in various exemplary embodiments, the paperboard packaging container 101 may be formed from a corresponding planar blank 150. The blank 150 is substantially in the form of a plurality of sections that interconnect or meet each other along various crease lines as the following description explains in more detail. The blank 150 includes first and second main faces 106 and 108 and first and second side faces 107 and 109. As shown in FIG. 4, respective crease lines b, c, and d are located between adjacent ones of the faces 106, 107, 108 and 109.

The faces 106, 107, 108 and 109 are substantially the same height H, while a width $W_m$ of the main faces 106 and 108 is greater than a width $W_s$ of the side faces 107 and 109 in the embodiment depicted, though this could be vice versa or the widths could be substantially similar. The first side face 107 is disposed between main faces 106 and 108, and the second side face 109 is laterally connected to the main face 108. A gluing flap 110 extends from the first main face 106 and is configured to connect the first main face 106 to the second side face 109 in the assembled configuration of the blank 150 to form a container. Thus, when assembled (i.e., when the gluing flap 110 is adhesively secured to the second side face 109), the main faces 106 and 108 and the side faces 107 and 109 cooperate to form a foldable box body 102 (See FIG. 2). The foldable box body 102 may, for example, define an inner space 119 (See FIG. 1B) that is suitable and large enough for containing the contents of the kit 100.

As shown in FIG. 4, bottom flaps 116, 117 and 118 respectively extend from one end of each face 107, 108 and 109, and are connected thereto at a crease line e that extends across the width of the faces 107, 108, and 109. When assembled, the bottom flaps 116, 117 and 118 are folded along the crease line e in a direction toward an interior of the formed box (e.g. into the plane of the drawing sheet), and cooperate to form a closed bottom end face 141 of the folding box (See FIGS. 2 and 3) as would be understood by those ordinarily skilled in the art. Similarly, cover flaps 111, 112, 113 and 114 respectively extend from an end of each face 106, 107, 108 and 109 opposite the end from which the flaps 116-118 extend. The cover flaps 111-114 are connected to the faces 106-109 at a crease line f that extends across the widths of the faces 106-109. When assembled, the cover flaps 111, 112, 113 and 114 are folded along the crease line f in a direction toward an interior of the formed box (e.g. into the plane of the drawing sheet), and cooperate to form a top end face 140 of the folding box (see FIGS. 2 and 3) as would also be understood by those ordinarily skilled in the art.

In various embodiments of the present disclosure, at least one end 140 and/or 141 of the folding box may be sealed, such as, for example, with a glue or other sealant, as would be understood by those ordinarily skilled in the art. As such, the seams created by the flaps may be sealed to make the ends of the folding box water tight (i.e., to help prevent the mixture of substances from leaking out of the portion 103 and/or the portion 104). As shown in the embodiment of FIGS. 1-3, for example, in various embodiments, a top end (i.e., 140) of the folding box may be sealed such that the portion 103 may be used to mix the substances.

In various additional embodiments, the blank 150 may further include support panels 115, 115*a*, and 115*b*. When assembled, the support panel 115 is folded along a crease line g in a direction toward an interior of the formed box (e.g. into the plane of the drawing sheet) and into the box along the front face 106. The support panels 115*a* and 115*b* are then respectively folded along crease lines h and i to line the side faces 109 and 107 (See FIG. 1B). As would be understood by those ordinarily skilled in the art, the support panels 115, 115*a*, and 115*b* are, for example, glued to an interior surface of each respective face 106, 109, and 107 to provide support to the foldable box body 102 (e.g., since the faces are perforated (i.e., weakened) as described below).

Each face 106, 107, 108 and 109 includes a respective portion of the perforated tear line 105, such that each face is divided into two respective portions 153 and 154 that together form the portions 103 and 104 of the separated container 101. Thus, when the foldable box is assembled, the perforated tear line 105 extends around the periphery of the container 101 as described above with reference to the embodiment of FIGS. 1-3. As also depicted in the exemplary embodiment of FIGS. 1-4, the container 101 may be torn along the perforated tear line 105 and portion 103 may be flipped up along a section 125 of the perforated tear line 105 (See FIG. 5A). The container 101 may then be torn along section 125 to separate portion 103 from portion 104 (See FIG. 5B). In various additional embodiments of the present disclosure, for example, section 125 may comprise a seam (i.e., that is not perforated), such that portion 103 may remain connected to portion 104 along face 108.

As shown in the embodiment of FIGS. 1-4, in various exemplary embodiments, the perforated tear line 105 is positioned at differing heights along the main faces 106 and 108, such that a front face 103*a* of portion 103 is higher than a back face 103*b* of portion 103 (See FIG. 3). Such a configuration not only gives portion 103 a unique shape, but reduces the risk of damage to the container 101 along the perforated tear line 105 (i.e., since the perforated tear line 105 along faces 106, 109 and 107 is positioned below the height of the support panels 115, 115*a*, and 115*b*).

Those ordinarily skilled in the art would understand that the container 101 is exemplary only that the size and/or configuration (i.e., dimensions and/or blank patterns) of the container 101 may be chosen based on the components being packaged, cost, manufacturing efficiency, and other such design factors. In accordance with various embodiments of the present disclosure, for example, a length (i.e., $W_m$ of blank 150) of the container 101 may range from about 3.5 inches to about 4.5 inches, a width (i.e., $W_s$ of blank 150) of the container 101 may range from about 2.375 inches to about 3.5 inches, and a depth (i.e., H of blank 150) of the container 101 may range from about 6.25 inches to about 6.5 inches. Thus, in accordance with various embodiments, a volume of the container 101 my range from about 59.38 square inches to about 79.63 square inches. Those ordinarily skilled in the art would understand, however, that the above dimensions and volumes are exemplary only, and may be particularly useful, for example, when packaging hair coloring products, such as, for example, hair dyes and highlighters. Furthermore, as would be understood by those ordinarily skilled in the art, the overall weight of the kit may be reduced due to the elimination of the plastic mixing tray, which may consequently reduce costs associated with shipping and/or handling. In various exemplary embodiments, for example, the weight of the kit may be reduced by about 11.4 grams due to the elimination of the plastic mixing tray. Those ordinarily skilled in the art would further understand that the size and/or configuration of the dividable portions 103 and 104 may be chosen based on the volume of substances to be mixed within the respective portions 103 and 104. In various embodiments, for example, the portion (i.e., 103 and/or 104) used to mix the substances may have a volume ranging from of about 17.5 cubic inches to about 25 cubic inches. It is, therefore, within the ability of one ordinarily skilled in the art to determine the number, pattern, and/or configuration of perforated tear lines 105 to obtain a portion 103 and/or a portion 104 of a sufficient capacity to permit the desired mixing.

Figure 6:
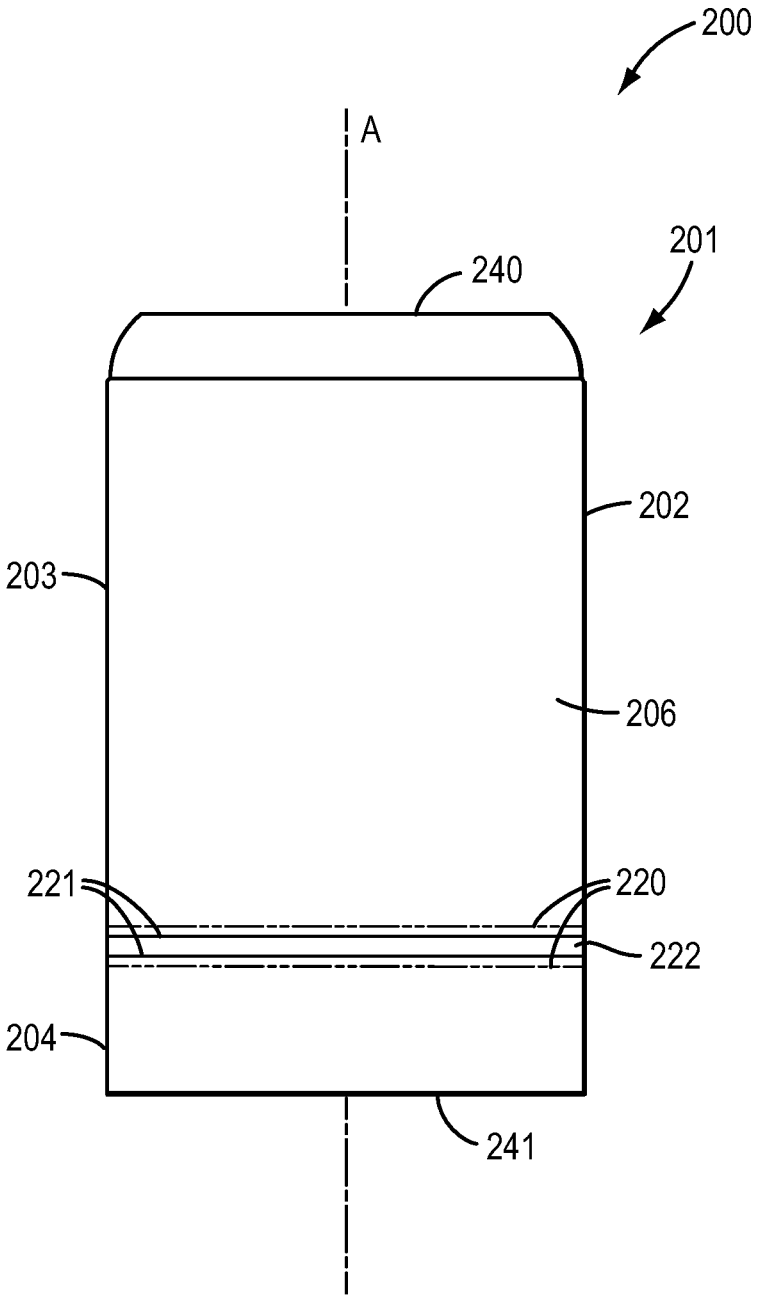
FIG. 6 is a front view of another exemplary embodiment of a packaging container for a hair treatment kit in accordance with the present disclosure.
Figure 7:
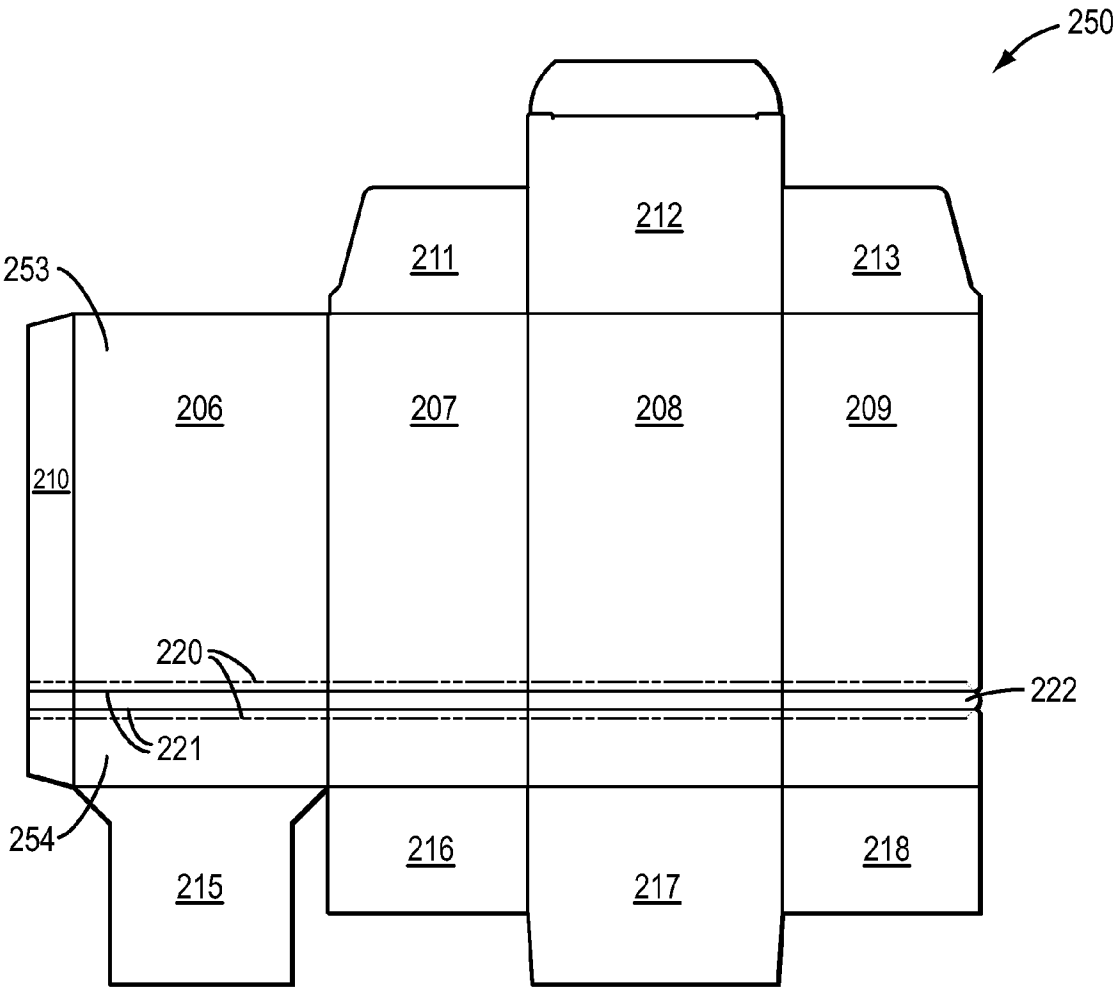
FIG. 7 shows a plan view of an exemplary embodiment of a blank used to form the packaging container of FIG. 6.

In various additional embodiments, for example, as shown with respect to FIGS. 6 and 7, a kit 200 may comprise a packaging container 201 having two sets of perforated tear lines 220 and 221 positioned so as to define a tear-off strip 222, as those having ordinary skill in the art are familiar with. As shown in FIG. 6, in various embodiments, the perforated tear lines 220 and 221 extend in a direction that is substantially transverse to a longitudinal axis A of the container 201. The tear-off strip 222 may, therefore, be torn to tear the container 201 into two portions 203 and 204, wherein at least one of the portions 203 and/or 204 is configured for receiving a mixture of at least two substances for application onto hair.

Those ordinarily skilled in the art would also understand that in various embodiments the entire container 101 may be used to mix the substances (i.e., without separating the container 101 into portions). In such a configuration, for example, the cover flaps of the box may be opened and the contents of the components 131 and 132 may be poured directly into the inner space 119 of the box.

Those ordinarily skilled in the art would further understand that the embodiments depicted in FIGS. 1-4 and 6 and 7 are exemplary only at that various additional packaging configurations are contemplated without departing from the scope of the present disclosure. In various embodiments, for example, the packaging container may be constructed using at least two separate pieces of paperboard, such that the pieces are configured to fit into one another to form a telescoping carton as understood by those ordinarily skilled in the art. Those having ordinary skill in the art would appreciate, based on the disclosure herein, various other embodiments of packaging containers that are configurable from a first configuration providing an inner space having the capacity to hold various kit components to be packaged to a second configuration providing a volume sufficient and configured to receive substances packaged in the kit for mixing together prior to use; such other packaging embodiments, configurations, and modifications to the exemplary embodiments herein are considered within the scope of the present disclosure and teachings.

As above, in accordance with various exemplary embodiments of the present teachings, the packaging container 201 may be a foldable box formed from a corresponding planar blank 250 as shown in FIG. 7. Similar to the blank 150 of FIG. 4, blank 250 includes first and second main faces 206 and 208, first and second side faces 207 and 209, and a gluing flap 210. Thus, as above, when assembled (i.e., when the gluing flap 210 is adhesively secured to the second side face 209), the faces 206-209 cooperate to form a foldable box body 202. The faces 206-209 each have two opposite ends, with a first end comprising bottom flaps 215, 216, 217 and 218 that cooperate to form a bottom end 240 of the foldable box, and a second end comprising cover flaps 211, 212, 213 and 214 that cooperate to form a top end 241 of the foldable box.

Each face 206-209 includes a respective portion of the perforated tear lines 220 and 221, such that each face is divided into two respective portions 253 and 254 that together form the portions 203 and 204 of the separated container 201. Thus, when the foldable box is assembled, the perforated tear lines 220 and 221 extend around the periphery of the container 201. The container 201 may therefore be torn along the perforated tear lines 220 and 221 via the tear strip 222 to separate portion 203 from portion 204.

As would be understood by those ordinarily skilled in the art, blanks in accordance with the present disclosure may be formed from various foldable materials, including, for example, various paperboard materials, such as, for example, a recycled cardboard product. Those ordinarily skilled in the art would further understand that blanks may be formed from a paperboard material with a hydrophobic coating, such as, for example, a low-density polyethylene (LDPE) coating. For example, at least portions of the blank that form interior surface portions of the box may be provided with a hydrophobic material coating or other layers deposited thereon. In various exemplary embodiments, both portions that form exterior and interior surface portions of the box may be provided with the hydrophobic material. Further, in various exemplary embodiments, portions of the blank may be provided with the hydrophobic material coating or layer and other portions may be free of the same. For example, in at least one exemplary embodiment, the hydrophobic material may be provided on the interior and/or exterior surface portions of the blank that form a portion of the box that is intended to be used for receiving and mixing the substances, for example, a top portion 153 and/or a bottom portion 154, as shown in the exemplary embodiment of FIG. 4.

With reference now to FIGS. 5A-5D, an exemplary method for using a hair treatment kit 500 in accordance with an exemplary embodiment of the present disclosure is set forth in the following description. As set forth in the exemplary embodiments of FIGS. 1-4, 6 and 7 above, a packaging container 501 can be opened to provide access to various components packaged in the container, including but not limited to, for example, containers 531 and 532 containing substances to be mixed for use in treating the hair, a mixing tool 533, and an applicator 534.

Figure 5A:
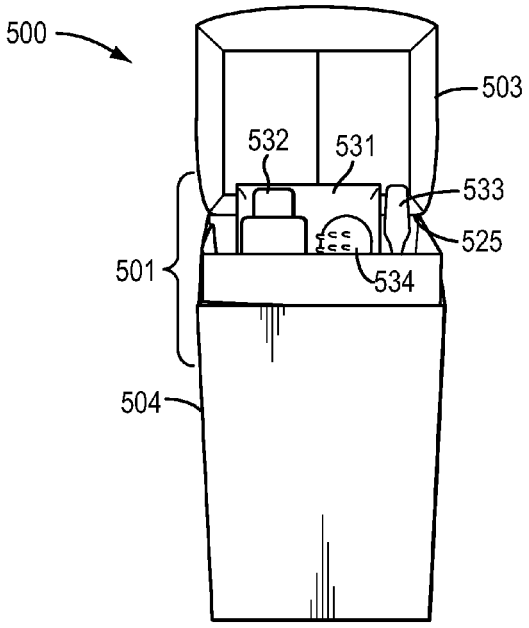
FIGS. 5A-5D illustrate exemplary steps of a method of treating hair using a kit in accordance with the present disclosure.

In accordance with various embodiments of the present disclosure, the packaging container 501 can be opened by tearing the packaging container 501 along at least one perforated tear line 505, which wraps at least partially around a periphery of the container 501 in a manner similar to that described with reference to the exemplary embodiments of FIGS. 1-3. As shown in FIG. 5A, in various embodiments, to open the container 501, the container 501 may be torn at the perforated tear line 505 and flipped open. In various embodiments, for example, a portion 503 of the container 501 may be flipped up along a section 525 of the tear line 505, and then torn along section 525 to be separated from a portion 504 of the container 501. In various additional embodiments, section 525 may comprise a seam (i.e., that is not perforated), such that portion 503 may be flipped open while remaining connected to portion 504.

Those ordinarily skilled in the art would understand, however, that the paperboard packaging container may be opened, and split into portions, using various techniques and/or methods, including, but not limited to, tearing and/or cutting the container. In various additional exemplary embodiments, for example, the paperboard packaging container 501 may be opened and split into portions 503 and 504 by tearing a tear-off strip. As those ordinarily skilled in the art would further understand, the tear-off strip may wrap around the entire periphery of the container 501, or partially around the periphery of the container 501 so as to provide a flip top configuration as described above.

Figure 5B:
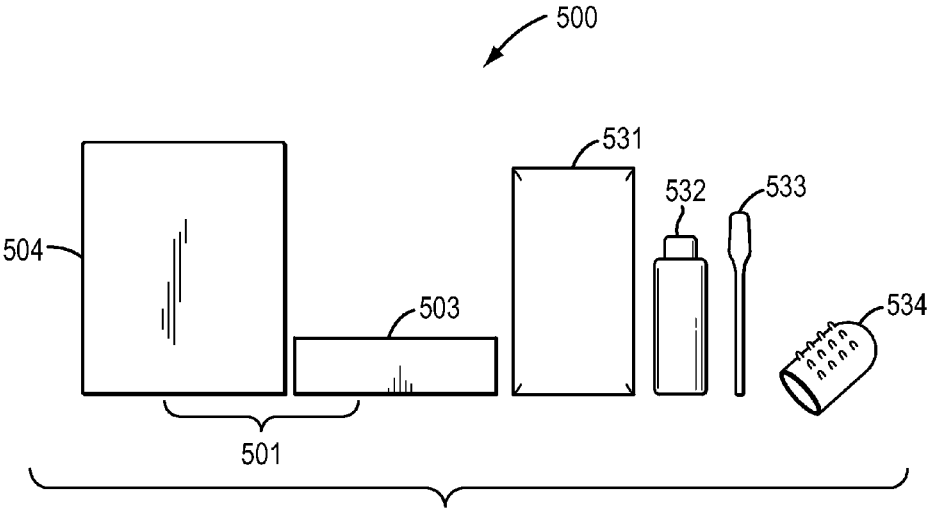

As shown in FIG. 5B, in at least one exemplary embodiment, the portion 503 may be completely detached from the portion 504, either by further tearing the container 501 along the perforated or non-perforated section 525, or by providing a tear line or tear strip around the entire periphery of the container 501.

After opening the container 501, the contents (e.g., the containers 531 and 532, the mixing tool 533, and the applicator 534) can be removed from the container 501, as is depicted in FIG. 5B.

Figure 5C:
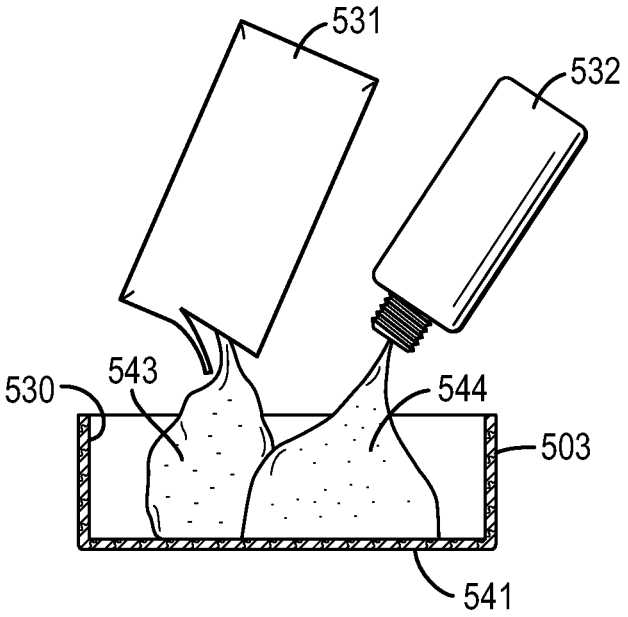

With reference to FIG. 5C, a hair treatment product 535 (see FIG. 5D), such as, for example, a hair coloring or relaxing product, may then be prepared by pouring the substances 543 and 544 from the containers 531 and 532 into the portion 503. Various embodiments of the present teachings contemplate, for example, that substances 543 and 544 may be poured directly into the portion 503 such that the portion 503 is configured for receiving the substances without leaking. As above, in various exemplary embodiments, for example, at least an interior surface 530 of the portion 503 can be hydrophobic, such as, for example, made of a paperboard coated or otherwise provided with a hydrophobic material, such as, for example, a LDPE coating. In various additional embodiments, portion 503 may be sealed. For example, flaps of a blank forming the closed end face 541 of the portion 503 can be sealed at the seams and/or along the edges with glue.

Although, as depicted in the exemplary embodiment of FIG. 5C, the substances 543 and 544 may be poured into a top portion (i.e., portion 503) of the packaging container 501, those ordinarily skilled in the art would understand that the substances 543 and 544 could alternatively be poured into a bottom portion of the container 501 (i.e., portion 504) for mixing together the substances 543 and 544 to form the hair treatment product 535.

As those ordinarily skilled in the art would understand, in various embodiments, the substances 543 and 544 may also be poured into the packaging container 501 without separating the container into portions 503 and 504, such that the entire volume of the container 501 may be used to mix the substances 543 and 544 together.

Figure 5D:
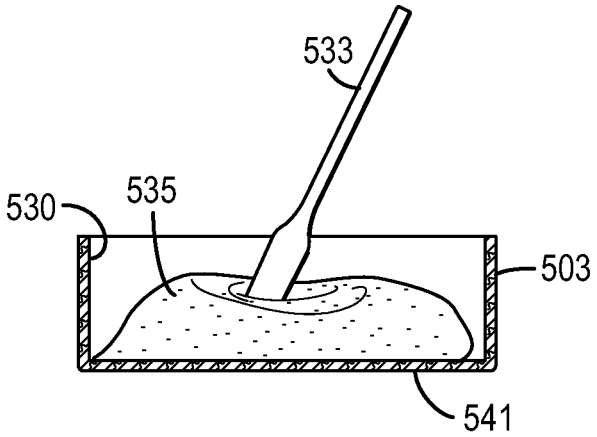

The substances 543 and 544 may then be mixed together within portion 503 to obtain the hair treatment product 535. Various embodiments of the present disclosure contemplate, for example, mixing the substances together with a mixing tool 533, as shown in FIG. 5D. Those ordinarily skilled in the art would understand, however, that various types of tools and/or methods may be used to mix the substances 543 and 544 together without departing from the scope of the present teachings. Those ordinarily skilled in the art would understand, for example, that the substances 543 and 544 may be mixed using various mixing tools, including, but not limited to, various types of spatulas, spoons and/or sticks.

Once the substances 543 and 544 have been sufficiently mixed, the mixture that forms a hair treatment product 535 can be applied to hair using the applicator 534 for example, as those ordinarily skilled in the art are familiar with. In various exemplary embodiments, the hair treatment product 535 is applied to the hair immediately after mixing the substances 543 and 544 together. Those ordinarily skilled in the art would further understand that the hair treatment product 535 may be applied using various application devices, including, but not limited to, various types of finger tools, combs and/or brushes.

Although the detailed description and exemplary illustrated embodiments were described with reference to hair treatment kits, it will be appreciated by those ordinarily skilled in the art having the benefit of this disclosure that the present disclosure may also provide packaging container embodiments, kits, and methods of use for various additional applications, such as, for example, various cosmetic and dermatological applications. In particular, the embodiments described could be used for a variety of purposes in which it is desirable to package one or more substances in separate containers, but that require mixing prior to application onto keratinous substrates (e.g., hair, skin, and/or nails). Further modifications and alternative embodiments to accommodate such applications would be apparent to those skilled in the art in view of this description.

The packaging container embodiments and kits may also include additional components that were omitted from the drawings for clarity of illustration. Accordingly, this description is to be construed as illustrative only and is for the purpose of teaching those skilled in the art the general manner of carrying out the present disclosure.

It is to be understood that the various embodiments shown and described herein are to be taken as exemplary. Elements and materials, and arrangements of those elements and materials, may be substituted for those illustrated and described herein, parts may be reversed, and certain features of the present disclosure may be utilized independently, all as would be apparent to one skilled in the art after having the benefit of the description herein. Changes may be made in the elements described herein without departing from the spirit and scope of the present disclosure and following claims, including their equivalents.

It is to be understood that the particular examples and embodiments set forth herein are non-limiting, and modifications to structure, dimensions, materials, and methodologies may be made without departing from the scope of the present disclosure.

It is to be further understood that this description's terminology is not intended to limit the invention. For example, spatially relative terms, such as "front", "back," "top", "bottom", "side," and the like, may be used to describe one element's or feature's relationship to another element or feature as intended to connote the orientation of the container for display and use and as illustrated in the figures. These spatially relative terms are intended to encompass different positions (i.e., locations) and orientations (i.e., rotational placements) of a container in use in addition to the position and orientation shown in the figures. For example, if a container in the figures is turned over, elements described as "top" or "bottom" would then be reversed. A container may also be otherwise oriented (rotated 90 degrees or at other orientations) and the spatially relative descriptors used herein interpreted accordingly.

For the purposes of this specification and appended claims, unless otherwise indicated, all numbers expressing quantities, percentages or proportions, and other numerical values used in the specification and claims, are to be understood as being modified in all instances by the term "about" if they are not already. Accordingly, unless indicated to the contrary, the numerical parameters set forth in the following specification and attached claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

It should be understood that while the present disclosure have been described in detail with respect to various exemplary embodiments thereof, it should not be considered limited to such, as numerous modifications are possible without departing from the broad scope of the appended claims, including the equivalents they encompass.

I claim:

1. A hair treatment kit consisting essentially of:

a paperboard box comprising a top wall, a bottom wall, and side walls disposed between and connecting the top and bottom walls, the top wall and a portion of the side walls defining a first portion of the paperboard box, and the bottom wall and remaining portions of the side walls define a second portion of the paperboard box, the paperboard box housing at least two containers in an interior portion thereof;

at least two different cosmetic compositions for treatment of hair housed in the at least two containers, the cosmetic compositions configured to be mixed together to form a cosmetic mixture for treating hair and comprising a dye and developer that mix to form a hair coloring product, or an alkaline component and an activator that mix to form a hair relaxing product; and optionally a mixing tool, an applicator, or both the mixing tool and the applicator;

wherein the first and second portions are arranged stacked along a longitudinal direction defined between the top and bottom walls, and the first and second portions are separated by at least one perforated tear line that wraps completely around a periphery of the paperboard box in a direction substantially transverse to the longitudinal direction, such that the first portion is configured to be completely detachable from the second portion at the perforated tear line for use as a mixing dish, the first portion defining a first volume ranging from about 17.5 cubic inches to about 25 cubic inches;

wherein a low-density polyethylene coating is provided on an interior surface of the paperboard box in at least the first portion thereof, where the coating forms a hydrophobic liquid barrier capable of blocking the compositions from penetrating the barrier when the compositions are mixed in the first portion; and wherein the kit does not include a mixing tray or bowl and does not define an empty volume sufficient for mixing the substances other than the paperboard box.

2. The kit of claim 1, wherein at least one end of the paperboard box is sealed.

* * * * *